US005138228A

United States Patent [19]

Thomas et al.

[11] Patent Number: 5,138,228

[45] Date of Patent: Aug. 11, 1992

[54] BULB GEOMETRY FOR LOW POWER METAL HALIDE LAMP

[75] Inventors: Brian J. Thomas, Phoenix; Daniel C. Briggs, Camillus; Michael Avdenko, Skaneateles Falls, all of N.Y.

[73] Assignee: Welch Allyn, Inc., Skaneateles Falls, N.Y.

[21] Appl. No.: 636,744

[22] Filed: Dec. 31, 1990

[51] Int. Cl.[5] ..... H01J 17/16; H01J 61/30

[52] U.S. Cl. ..... 313/634; 313/284; 313/286; 313/46; 313/44

[58] Field of Search ..... 313/284, 285, 286, 290, 313/631, 632, 634, 570, 571, 46, 44

[56] References Cited

U.S. PATENT DOCUMENTS 4,594,529 6/1986 de Vrijer ..... 313/571
4,850,500 7/1989 White et al. ..... 220/2.1 R
4,968,916 11/1990 Davenport et al. ..... 313/571

*Primary Examiner*—Donald J. Yusko
*Assistant Examiner*—N. D. Patel
*Attorney, Agent, or Firm*—Wall and Roehrig

[57] ABSTRACT

A low-wattage metal-halide discharge lamp has a tube of the double ended type that forms a bulb or envelope, a pair of electrodes, e.g., an anode and a cathode, which penetrate into an arc chamber inside the envelope, and a suitable amount of mercury plus one or more metal halide salts. The electrodes are each formed of a refractory metal, i.e., tungsten wire, extending through the respective necks into the arc chamber. Heat transfer along the tube wall and through the necks is controlled by designing the bulb wall so that the cross sectional areas at the necks and at quarter-chamber planes halfway between the necks and a midplane have a respective quarter chamber loading factor and a neck loading factor each within a desired range. Lamps of this design achieve high efficacy at relatively low power, i.e., below 40 watts.

14 Claims, 2 Drawing Sheets

BULB GEOMETRY FOR LOW POWER METAL HALIDE LAMP

BACKGROUND OF THE INVENTION

The present invention relates to metal halide vapor discharge lamps, and is more particularly directed to lamps that have efficacies in excess of 35 lumens per watt, in some cases over 100 lumens per watt, at low to medium power, i.e., under 30 watts, in some cases 40 watts. The present invention is more specifically concerned with quartz tube geometry which, in combination with the electrode structure and the mercury, metal halide, and noble gas fill, makes the high efficacy possible.

Metal halide discharge lamps typically have a quartz tube that forms a bulb or envelope and defines a sealed arc chamber, a pair of electrodes, e.g. an anode and a cathode, which penetrate into the arc chamber inside the envelope, and a suitable amount of mercury and one or more metal halide salts, such as NaI, or $ScI_3$, also reposed within the envelope. The vapor pressures of the metal halide salts and the mercury affect both the color temperature and efficacy. These are affected in turn by the quartz envelope geometry, anode and cathode insertion depth, arc gap size, and volume of the arc chamber in the envelope. Higher operating temperatures of course produce higher metal halide vapor pressures, but can also reduce the lamp life cycle by hastening quartz devitrification and causing tungsten metal loss from the electrodes. On the other hand, lower operating temperatures, especially near the bulb wall, can cause salt vapor to condense and crystallize on the walls of the envelope, causing objectionable flecks to appear in objects illuminated by the lamp.

Many metal halide discharge lamps of various styles and power ranges, and constructed for various applications, have been proposed, and are well known to those in the lamp arts. Lamps or this type are described, e.g. in U.S. Pat. Nos. 4,161,672; 4,808,876; 3,324,332; 2,272,467; 2,545,884; and 3,379,868. These are generally intended for high power applications, i.e., large area illumination devices or projection lamps. It has not been possible to provide a small lamp of high efficacy that could be used in a medical examination lamp or other application at a power of under about 40 watts. No one has previously approached lamp building with a view towards applying heat management principles to produce a lamp that would operate at low power and high efficacy and would also develop sufficient mercury and metal halide vapor pressures within the arc chamber without causing devitrification and softening of the quartz tube envelope, and without causing damage to the tungsten electrodes.

OBJECTS AND SUMMARY OF THE INVENTION

It is an object of the present invention to provide a low-power, high-efficacy metal-halide discharge lamp that avoids the drawbacks of such lamps of the prior art.

It is a more specific object to provide a metal-halide discharge lamp that has reasonably long life while delivering light at efficacies exceeding 35 lumens per watt.

It is a still more specific object to provide bulb geometry that permits effective management of heat flow from the arc chamber and out the shanks of the lamp, and thus promotes high-efficacy illumination at low power input.

In accordance with an aspect of the present invention, the lamp has a quartz tube envelope of the double-ended type having a first neck on one end and a second neck on an opposite ends of a bulb. There are suitable quantities of mercury and metal halide salt or salts contained within the bulb. The bulb wall defines a cavity or arc chamber to contain the metal halide salt vapors and mercury vapor during operation. First and second elongated electrodes formed of a refractory metal, i.e., tungsten wire, extend through the respective necks into the arc chamber. These electrodes are aligned axially so that their tips define an arc gap between them of a suitable arc length.

The bulb wall thickness increases gradually from a mid-chamber plane, i.e., a plane midway between the two necks, to the respective necks. At first and second quarter-chamber planes, i.e., planes positioned halfway between the mid-chamber plane and each of the first and second necks, the bulb wall has respective first and second annular quarter-chamber cross sectional areas, respectively. The wall is formed with an appropriate thickness relative to the lamp's rated power or wattage, so that the lamp has a quarter chamber loading factor within a target range. This loading factor is equal to the rated power of the lamp divided by the sum of the first and second quarter-chamber cross sectional areas. This loading factor should be in a range of 70 to 350 watts per square centimeter.

Also, the quartz necks which join the arc chamber to the quartz shanks are constricted somewhat to produce a neck loading factor within a target range. This produces optimal heat flow management so that high efficacy can be achieved. Here each of the first and second necks has a cross sectional area $XQ_1$, $XQ_2$ where the respective electrode enters the arc chamber, and the electrodes also each have a cross sectional area $XE_1$, $XE_2$, at this position. The neck loading factor NL can be expressed $$NL = \frac{P}{XQ_1 + XQ_2 + A\,(XE_1 + XE_2)}$$

where P is the rated power and A is a thermal conductivity coefficient (on the order of about 90) which accounts for the fact that the tungsten wire conducts heat more readily than glass or quartz. The neck loading factor should be in the range of about 100 to 400 watts per square centimeter.

Lamps of this design can operate at low power (5 to 14 watts) or intermediate power (14 to 30 watts) depending on the intended application, and in each case with a high efficacy. The efficacy can exceed 100 lumens per watt in some cases.

The narrow size of the lead-in wire portion of the electrode prevents thermomechanical stressing of the quartz of the neck, which has a thermal coefficient of expansion quite different from tungsten.

Preferably, the chamber has flared regions where the necks join the bulb, so that there is an extended region, of very small volume, where each lead-in wire is out of direct contact with the quartz as it enters the chamber. This feature facilitates condensation of salt reservoirs at the neck behind one or the other of the electrodes and also facilitates control of heat flow from the hot electrodes out into the necks of the lamp. The foregoing and other objects, features, and advantages of the invention will be more fully appreciated from the ensuing detailed description of selected preferred embodiments, to be considered in conjunction with the accompanying Drawing.

DETAILED DESCRIPTION OF THE PREFERRED EMBODIMENT

Figure 1:
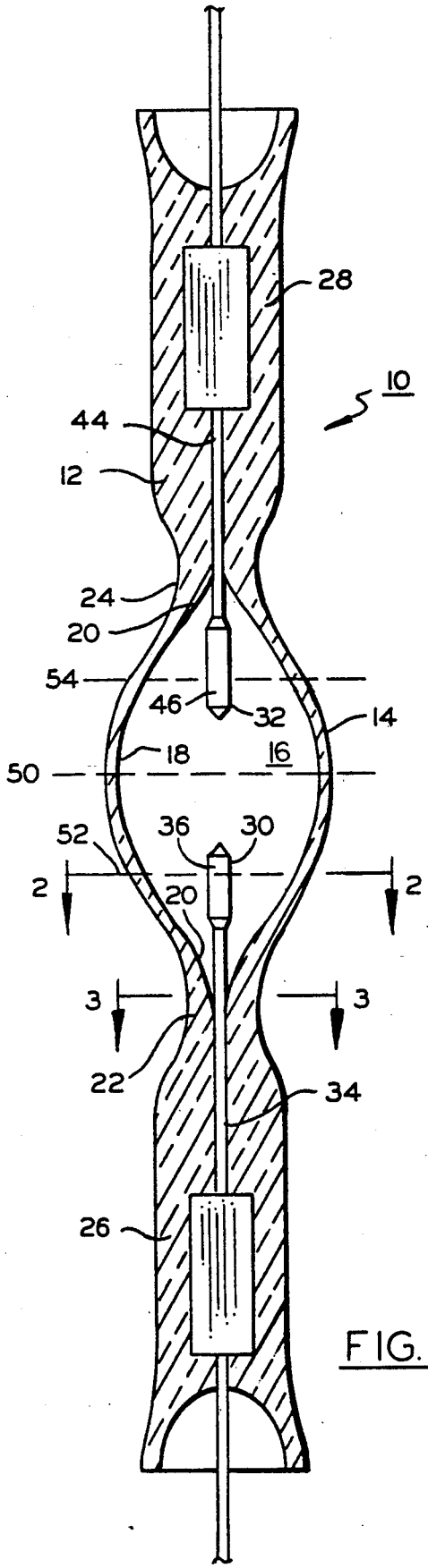
FIG. 1 is an elevational view of a quartz metal halide discharge lamp according to one embodiment of this invention.

With reference to the Drawing, and initially to FIG. 1, a twentytwo-watt lamp 10 comprises a double-ended fused quartz tube 12 which is formed by automated glass blowing techniques. The tube has a thin-wall bulb 14 at a central portion defining within it a cavity or chamber 16. In this case, the chamber is somewhat lemon shaped or gaussian shaped, having a central convex portion 18, and flared end portions 20 where the bulb 14 joins the first and second necks 22, 24, respectively. As illustrated, the necks 22 and 24 are each narrowed-in or constricted, which restricts heat flow out into respective first and second shanks 26 and 28.

There are first and second electrodes 30 and 32, each supported in a respective one of the necks 22, 24. The electrodes are formed of a refractory metal, e.g. tungsten, and are of a "composite" design, that is, more-or-less club-shaped.

The first electrode 30, which serves as anode, has a lead-in tungsten wire shank 34 that is supported in the neck 22 and extends somewhat into the chamber 16 where a tungsten post portion 36 is butt-welded onto it. The lead-in wire is of rather narrow gauge, typically 0.007 inches and the post portion is of somewhat greater diameter, typically 0.012 inches. The post portion 36 has a conic tip which forms a central point with a flare angle in the range of 60 degrees to 120 degrees.

The tungsten lead-in wire 34 extends through the quartz shank 26 out to a molybdenum foil seal which connects with a molybdenum lead-in wire that provides an electrical connection to the positive terminal of an appropriate ballast (not shown).

The cathode electrode 32 similarly has a tungsten lead-in wire 44 that extends in the shank 28 and is supported in the neck 24. The wire 44 extends somewhat out into the chamber 16 and a post portion 46 is butt-welded onto it. The cathode post portion 46 has a pointed, conic tip with a taper angle on the order of 30 to 45 degrees. Here the wire 44 is typically of 0.007 inches diameter while the post portion can be e.g., of 0.012 inches diameter. The lead-in wire 44 extends to a molybdenum foil seal that connects to an inlead wire.

The post portions 36, 46 of the anode and cathode are supported out of contact with the necks 22, 24, and out of contact with the walls of the bulb 14. The specific electrode structure is described in commonly assigned copending U.S. patent application No. Ser. No. 636,713 filed Dec. 31, 1990, now U.S. Pat. No. 5,083,0 and the description there is incorporated here by reference.

The anode 30 and cathode 32 are aligned axially, and their tips define between them an arc gap in the central part of the chamber 16.

The post portions have a rather large surface area that is in contact with the mercury and metal halide vapors in the lamp, so the heat conducted away from the pointed tips is largely transferred to the vapors in the chamber.

While not shown in this view, the lamp 10 also contains suitable fill of a small amount of a noble gas such as argon, mercury, and one or more metal halide salts such as sodium iodide, scandium iodide, or indium iodide. The particular metal salts selected, and their respective proportions, depend on their optical discharge characteristics of the metal ions in relation to the desired wavelength distribution for the lamp.

The lead-in wires for the electrodes, being made of tungsten, have about 90 to 96 times higher coefficient of heat conductivity than does the quartz material of the tube 12. Therefore, it is desirable to keep the lead-in wires 34, 44, as small in diameter as is possible. The smaller-diameter lead-in wire portions of the electrodes will experience only a relatively small amount of thermal expansion due to heating of the tungsten wire. This occurs for two reasons: The smaller-diameter wire does not carry nearly as much heat up the respective necks as if electrodes the size of the post portions continued up to the necks. Secondly, the amount of thermal expansion is proportional to the over-all size; thus where the size is kept small, stresses due to thermal expansion are also kept small. Because of this, the construction principles employed here present a reduced risk of cracking of the fused quartz due to the differential thermal expansion of the quartz and tungsten materials.

Figure 2:
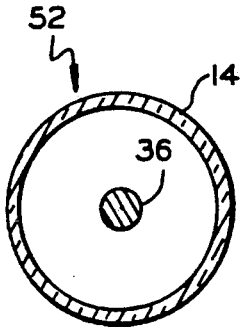
FIGS. 2 and 3 are cross sectional views taken at 2—2 and 3—3 of FIG. 1.

As is also shown in FIG. 1, the thickness of the wall of the bulb 14 increases gradually from a center or mid-plane 50 that is perpendicular to the lamp axis and is midway between the two necks 22 and 24. The wall thickness is kept within limits based on the lamp wattage and bulb dimension, so as to regulate thermal conductive heat flow along the quartz bulb wall from the zone near the arc gap towards the first and second shanks 26 and 28. This can be expressed as a function of the cross sectional area loading at first and second cross sections of the bulb wall taken at first and second quarter chamber planes 52 and 54 that are respectively midway between the mid-plane 50 and the respective necks 22 and 24. As shown in FIG. 2, the cross section of the bulb wall 14 at the plane 52 is an annulus whose surface area can be calculated from the wall thickness and the radius from the axis. The electrode post 36 is shown on the axis in FIG. 2.

Figure 3:
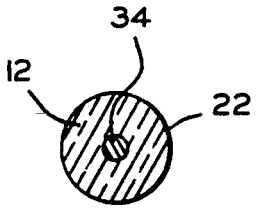

As also shown in FIG. 1, each of the necks 22, 24 is constricted at a position that corresponds to the plane at which the respective electrode 30, 32 leaves the neck and enters the chamber 16. The necks have a limited cross sectional area for the quartz tube 12 at this plane, as illustrated in FIG. 3. The lead-in wire shank 34 of the first electrode 30 is also shown at the axis of the tube 12 at this plane.

For optimal efficacy, the quartz bulb loading factor should satisfy both quarter chamber loading and neck loading criteria.

As to quarter chamber loading, that factor, expressed as QCL, can be defined as equal to the rated power P of the lamp (e.g. 22 watts) divided by the sum of the cross sectional areas $XC_1$, $XC_2$ at the first and second quarter chamber planes 52 and 54:

$$QCL = \frac{P}{XC_1 + XC_2},$$

and this quarter chamber loading factor QCL should be within a range of about 70 to 350 watts per square centimeter. The variation within this range permits different fills of salt to be used for different vapor pressures and different color temperatures as may be needed for various applications.

The neck loading factor NL can be expressed as the rated power P of the lamp 10 divided by the sum of the quartz cross section $XQ_1+XQ_2$ at each neck, and the sum of the electrode cross sections $XE_1+XE_2$ at the two necks times a factor A that accounts for the much higher thermal conductivity of tungsten over the quartz or silica:

$$NL = \frac{P}{XQ_1 + XQ_2 + A\,(XE_1 + XE_2)}$$

The factor A is typically on the order of 90 to 96, and can be approximated as being equal to 90. For optimal operation the neck loading factor NL should be within a range of about 100 to 400 watts per square centimeter.

In one typical twenty-two watt lamp of this invention, the neck loading factor was measured at approximately 280 w/cm$^2$, and the quarter chamber loading factor was about 90 w/cm$^2$.

Figure 4:
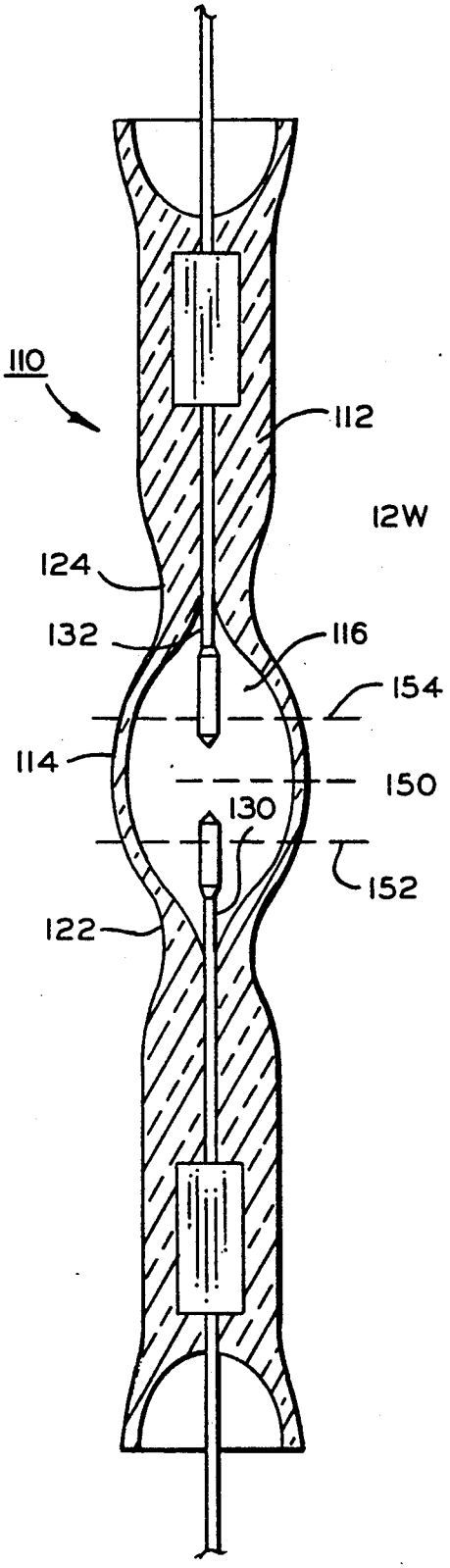
FIGS. 4 and 5 are elevational views of other embodiments of this invention.
Figure 5:
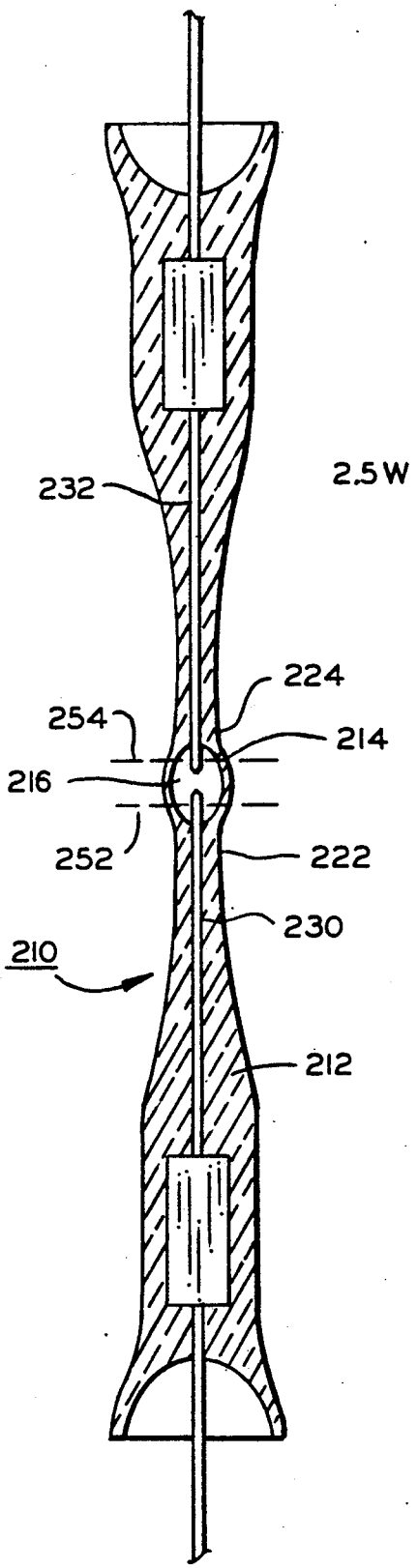

FIG. 4 shows another lamp 110 of this invention, here of intermediate power, that is between five and fifteen watts. The same consideration as discussed above are considered in the design and construction of this lamp, and elements that corresponds to elements in the previously described embodiment employed the same reference numbers, but raised by 100.

Here, the lamp 110 has a double ended fused quartz tube 112, with a bulb 114 whose wall defines an arch chamber 116 that contains a fill of mercury, a halogen salt, and a small quantity of a noble gas. There are first and second constricted necks 122 and 124 through which first and second electrodes 130 and 132 enter the chamber 116. As in the first embodiment, there is a mid-plane 150 midway between the necks 122, 124 and quarter chamber planes 152 and 154 each halfway between the mid-plane and a respective one of the necks 122 and 124. The quarter chamber loading factor is determined, as described previously, from the rated power of the lamp and the wall cross-sectional areas at these planes 152 and 154.

The quarter-chamber loading factor should be maintained within the range of 100 to 350 watts per square centimeter.

The neck loading factor is also determined as described previously based on the quartz and tungsten wire cross sectional areas at the two necks 122 and 124. The neck loading factor should be within the range 100 to 400 watts per square centimeters. For one typical fourteen watt lamp of this invention, the neck loading factor was 180 w/cm$^2$ and the quarter chamber loading was 170 w/cm$^2$.

A very-low-power lamp 210 of this invention is shown in FIG. 3, the lamp having a rated power of under five watts. Here the same design consideration are employed as in the previous embodiments, and a high efficacy is achieved of 40 lumens per watt or higher. Elements that correspond to those of the first embodiment are identified with the same reference characters, but raised by 200. Here, there is a fused quartz tube 212 with a correspondingly smaller bulb 214 formed therein with a wall that defines an arc chamber. Through first and second constricted necks 222 and 224 at either end of the bulb there emerge first and second tungsten wire electrodes 230 and 232. These define a small arc gap within the chamber 216, and there is a suitable fill of mercury, salt, and noble gas. Here, the electrodes 230, 232 are of uniform diameter wire, rather than of composite design as employed in the lamp of FIGS. 1 and 4.

Quarter chamber loading is determined based on the rated power and on the bulb wall cross sections at quarter chamber planes 252 and 254. Neck loading is likewise determined based on the rated power and the quartz and tungsten wire cross sections at the first and second necks 222 and 224.

As in the other embodiments, the quarter chamber loading factor for this lamp 210 should be maintained in the range 100 to 350 watts per square centimeter, and the neck loading factor should be maintained in the range of 100 to 400 watts per square centimeters. In one specific lamp of this invention with a rated power of 2.5 watts, the neck loading factor was about 240 w/cm$^2$, and the quarter chamber loading was about 215 w/cm$^2$.

In each of the larger lamps (15 to 40 watts), intermediate lamps (5 to 14 watts) and smaller lamps (under 5 watts), heat management principles are employed to limit the flow of heat along the quartz wall of the bulb and out the necks onto large radiating surfaces of the shanks. Hot turbulent gases in the zones between the electrode tips, i.e., in the vicinity of the arc-generated plasma, perform most of the heat transfer function in the central part of the chamber. However, as heat proceeds axially towards the necks, the conductivity in the quartz bulb wall plays a greater factor. The rate of heat flow should be kept within a range so that temperatures remain high enough to keep mercury and salt vapor pressures high. However, some heat must be conveyed away to keep high temperature from devitryifying the fused quartz bulb wall. Also, excess salt, i.e., a salt reservoir, should condense away from the central part of the bulb wall, and in this invention, the coolest part of the chamber in the operating lamp is at one of the necks behind the electrode, the salt reservoir forms there. Thus, flecks of condensed salt do not form on the convex portion 18 of the bulb wall in the path of illumination.

The necks, bulb side walls, and shanks of the quartz tube are required to be thick enough for structural support, and to transfer sufficient heat to prevent devitrification, while being dimensioned small enough for retaining heat to produce the high vapor pressures that result in high lamp efficacy and desired color temperatures at the low rated power employed.

While this invention has been described in detail with reference to selected preferred embodiments, it should be understood that the invention is not limited to those precise embodiments. Rather, many modifications and variations would present themselves to those of skill in the art without departing from the scope and spirit of this invention, as defined in the appended claims.

What is claimed is:

1. A metal halide discharge lamp that includes a tube envelope of the double-ended type having a first neck and a second neck axially arranged on opposite ends of a bulb and joining first and second shanks to the bulb which has a bulb wall that defines an arc chamber of a predetermined volume, said first and second necks being pinched in to restrict heat flow from the bulb wall to the respective shanks, predetermined quantities of mercury and a metal halide salt within said chamber, and first and second elongated electrodes of a refractory metal each extending axially through a respective one of said necks into said arc chamber, the electrodes having axial tips spaced apart to define an arc gap therebetween, said lamp having a rated power that depends on said chamber volume, the quantities of mercury and salt in the chamber, and the arc gap; and wherein the bulb wall has a thickness that increases gradually from a mid-chamber plane, midway between said necks and normal to the axis of the lamp, to the respective first and second necks; and said bulb wall has first and second quarter-chamber planes normal to said axis and midway between said mid-chamber plane and the respective first and second necks, said wall having respective first and second quarter-chamber cross sectional areas at said first and second quarter-chamber planes, respectively, wherein said lamp has a rated quarter-chamber loading factor equal to the rated power of the lamp divided by the sum of the first and second quarter chamber cross sectional area, said rated quarter-chamber loading factor being in the range of 70 to 350 watts per square centimeter.

2. A metal halide discharge lamp according to claim 1 wherein said rated power is between 2 watts and 5 watts.

3. A metal halide discharge lamp according to claim 1 wherein said rated power is between 5 watts and 14 watts.

4. A metal halide lamp according to claim 1 wherein said rated power is between about 15 watts and 40 watts.

5. A metal halide discharge lamp according to claim 1 wherein said chamber is of a generally gaussian interior shape with flared portions at the necks where the respective electrodes enter the chamber and a convex portion between said flared portions.

6. A metal halide lamp according to claim 5 wherein outer surfaces of said first and second necks are pinched in to restrict heat flow along the bulb wall and out the shanks.

7. A metal halide discharge lamp that includes a tube envelope of the double ended type having a first neck and a second neck axially arranged on opposite ends of the bulb and joining first and second shanks to the bulb which has a bulb wall that defines an arc chamber of a predetermined volume, predetermined quantities of mercury and a metal halide salt within said chamber, and first and second elongated electrodes of a refractory metal each extending axially through a respective one of said necks into said arc chamber, the electrodes having axial tips spaced apart to define an arc gap therebetween, said lamp having a rated power P that depends on said chamber volume, the quantities of mercury and salt in the chamber, and the arc gap; and wherein the necks have first and second neck cross sectional areas $XQ_1$ and $XQ_2$ respective necks where the respective electrodes enter the chamber, and the first and second electrodes have cross sectional area $XE_1$ and $XE_2$ where the electrodes enter the chamber and the refractory metal of the electrodes has a thermal conductivity that is A times as great as that of the tube; and the lamp has a neck power loading factor $$NL = \frac{P}{XQ_1 + XQ_2 + A\,(XE_1 + XE_2)}$$

a range of 100 to 400 watts per square centimeter.

8. A metal halide discharge lamp according to claim 7 wherein said rated power P is between 2 watts and 5 watts.

9. A metal halide discharge lamp according to claim 7 wherein said rated power is between 5 watts and 14 watts.

10. A metal halide discharge lamp according to claim 7 wherein said rate power P is between about 15 watts and 40 watts.

11. A metal halide discharge lamp according to claim 7 wherein said chamber is of a generally gaussian interior shape with flared portions at the necks where the respective electrodes enter the chamber and a convex portion between said flared portions.

12. A metal halide discharge lamp according to claim 11 wherein outer surfaces of said first and second necks are pinched in to restrict heat flow along the bulb wall and out shanks.

13. A metal halide discharge lamp according to claim 7, wherein said electrodes are formed of tungsten wire and have a ratio of thermal conductivity relative to the thermal conductivity of quartz on the order of about 90.

14. A quartz halogen discharge lamp according to claim 13 wherein said tungsten wire has a diameter at said necks of about 0.007 inches.

* * * * *